United States Patent [19]

Olsen et al.

[11] 4,365,225

[45] Dec. 21, 1982

[54] TIME DELAY RELAY WITH SPRING CLIPS

[75] Inventors: Donald A. Olsen, Millis, Mass.; Henry J. Boulanger, Cumberland, R.I.

[73] Assignee: Texas Instruments Incorporated, Dallas, Tex.

[21] Appl. No.: 146,979

[22] Filed: May 5, 1980

[51] Int. Cl.[3] ..... H01H 37/52

[52] U.S. Cl. ..... 337/88; 337/107; 337/354

[58] Field of Search ..... 337/88, 102, 112, 341, 337/354, 377, 107

[56] References Cited

U.S. PATENT DOCUMENTS

| | | | |
|---|---|---|---|
| 3,500,277 | 3/1970 | Hardulli | 337/88 X |
| 3,858,139 | 12/1974 | Hunter | 337/88 |
| 3,858,140 | 12/1974 | Hancock | 337/88 |
| 4,136,323 | 1/1979 | D'Entremont et al. | 337/102 X |
| 4,177,443 | 12/1979 | Willeke | 337/102 X |
| 4,224,591 | 9/1980 | Senor | 337/102 |

*Primary Examiner*—George Harris

*Attorney, Agent, or Firm*—James P. McAndrews; John A. Haug; Melvin Sharp

[57] ABSTRACT

A time delay relay has a switch assembly, a spring terminal assembly, and an electrical resistance heater unit of an inexpensive construction held together in a reliable and economical manner by a pair of easily mounted metal spring clips. The clips have opposite ends each securely hooked over portions of the terminal assembly and resiliently engaged with respective, oppositely-facing surfaces of the switch and terminal assemblies so that the heater unit is firmly held in a predetermined position in the relay with opposite electrical poles of the unit resiliently engaged with respective terminals in the terminal assembly for directing electrical current through the heater, so that a thermally-responsive dished thermostatic disc is disposed in close heat-transfer relation to the heater unit at a location where it is free to move at a precisely predetermined temperature as it is heated by the heater unit, and so that a motion transfer pin is guided for free movement in response to the disc movement to provide snap-acting opening and closing of electrical contacts in the switch assembly.

5 Claims, 3 Drawing Figures

TIME DELAY RELAY WITH SPRING CLIPS

BACKGROUND OF THE INVENTION

The invention relates to a time delay relay having an electrical heater energizeable for heating a bimetallic disc so that the disc moves a switch to open or close an electrical circuit with a selected time delay after the heater has been energized. The invention relates more particularly to a relay structure in which low-cost components are adapted to be accurately and reliably assembled to provide a high-performance device in an economical manner.

Certain low-cost high-performance time delay relay devices have conventionally incorporated a thermally-responsive electrical switch together with a separate terminal assembly and with a separate electrical heater. The individual device components are easily made at low cost in large volume and are then assembled to provide the desired relay. Such relays have been assembled using plastic clips or the like wherein clip ends press into lateral holes in the relay housing as shown in U.S. Pat. No. 3,858,139. Alternately, such relays have been assembled using clip-type terminals which cooperate with a retainer as shown in U.S. Pat. No. 3,858,140. Typically, however, in order to assure that device components are securely and accurately held together, the relays have been assembled using adhesive means which usually require time-consuming and expensive curing and the like after device assembly has been completed.

SUMMARY OF THE INVENTION

It is an object of this invention to provide a novel and improved time delay relay; to provide such a relay which is reliably assembled in an economical manner; and to provide such a relay having an electrical switch assembly, a heater unit, and a thermally responsive member wherein the device components have a novel structure permitting the components to be easily and reliably assembled to form a relay using only a pair of easily-mounted metal clips having opposite clip ends which bear against oppositely facing surfaces of the switch and terminal assemblies.

Briefly described, the novel and improved time delay relay of this invention includes a terminal assembly having a housing of rigid insulating material forming a circularly-walled chamber open at one end. Abutments are spread around the inner chamber wall at a selected distance from the open chamber end and a pair of resilient electrically conductive terminals are united to the housing with first terminal ends located near the abutments and with opposite terminal ends extending out of the housing chamber through the chamber walls. The housing has slots in the chamber wall at the open end of the chambers and also has a base slot formed in the opposite end of the terminal housing, the base slot including tapered reentrant surface portions adjacent to the respective ends of the slot.

An electrical resistor of a ceramic material having a positive temperature coefficient of resistivity has one side secured in electrically and thermally conducting relation to the bottom, outer surface of a flanged and stepped thermally and electrically conducting metal cup and an electrical contact layer is formed on the opposite side of the resistor, thereby to form a self-regulating electrical resistance heater unit. The heater is disposed in the housing chamber with the cup flange resting on the housing abutments to precisely position the heater in the housing so that the cup bears against one resilient terminal and the resistor contact layer bears resiliently against the other terminal. A thermally-responsive thermostat metal disc, having a dished configuration so that the disc is adapted to move to an inverted dished configuration with snap-action when the disc is heated to a predetermined temperature, is disposed within the heater cup with the disc perimeter resting on the cup step in close heat-transfer relation to the cup.

The relay further includes a switch assembly having contact means mounted in a first part of the switch for movement between open and closed circuit positions, the first switch portion being fitted into the slot means at the open end of the terminal housing chamber. The switch assembly also includes a depending, generally cylindric switch part which fits down into the housing chamber to locate the switch assembly on the housing and to bear against the flange of the heater unit cup, thereby to secure the heater in place against the terminal housing abutments. The cylindric switch part includes an annular end abutment which fits inside the heater unit cup to center the cup on the cylinder part and to retain the disc in the cup; includes an axial guide passage slidally receiving a motion transfer pin which extends between the snap-acting disc and the moveable switch contact means; and includes a pair of bosses on the outer circumference of the cylindric switch part which fits down inside the terminal housing chamber. The bosses are aligned over the respective ends of the terminal housing base slot.

A pair of metal clips each have one end hooked over the rim of the circular housing chamber wall to fit down into the open ended housing chamber and to bear against the respective bosses in the cylindric switch part. The clips also have opposite ends which are hooked into the respective ends of the terminal housing base slot and are resiliently received in the respective tapered, reentrant portions of the base slot to pull the switch assembly firmly into desired position in the terminal assembly housing, thereby to form the desired relay and to lock the clips into the relay structure. In that way, various relay components have novel low-cost structural features relating to relay assembly and simple and reliable metal clips are easily mounted on the relay components for holding the components securely together in assembled relation. The clips assure that the heater unit is firmly engaged with terminals for selectively energizing the heater unit, assure that the heater unit is securely held in a desired location to heat the thermally responsive element with a desired time delay, and assure that the thermally responsive disc and its associated motion transfer member are properly positioned for free movement at the desired temperature for actuating the switch component of the relay with a desired time delay after heater energization.

BRIEF DESCRIPTION OF THE DRAWING

Other objects, advantages and details of the improved time delay relay of this invention appear in the following detailed description of preferred embodiments of the invention, the detailed description referring to the drawings in which.

DESCRIPTION OF THE PREFERRED EMBODIMENTS

Figure 1:
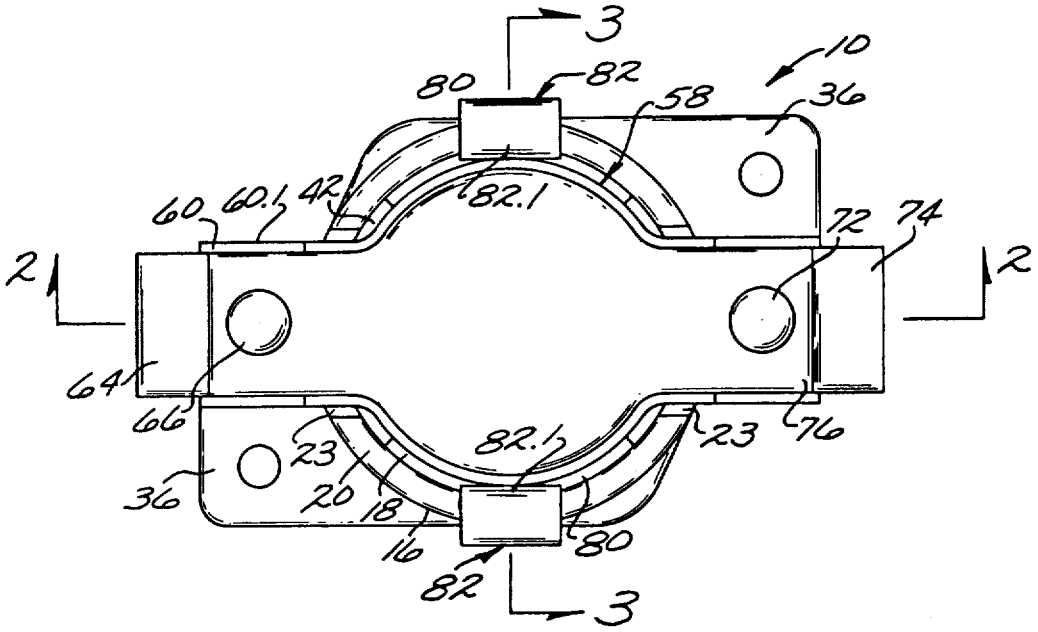
FIG. 1 is a plan view of the time delay relay of this invention.
Figure 2:
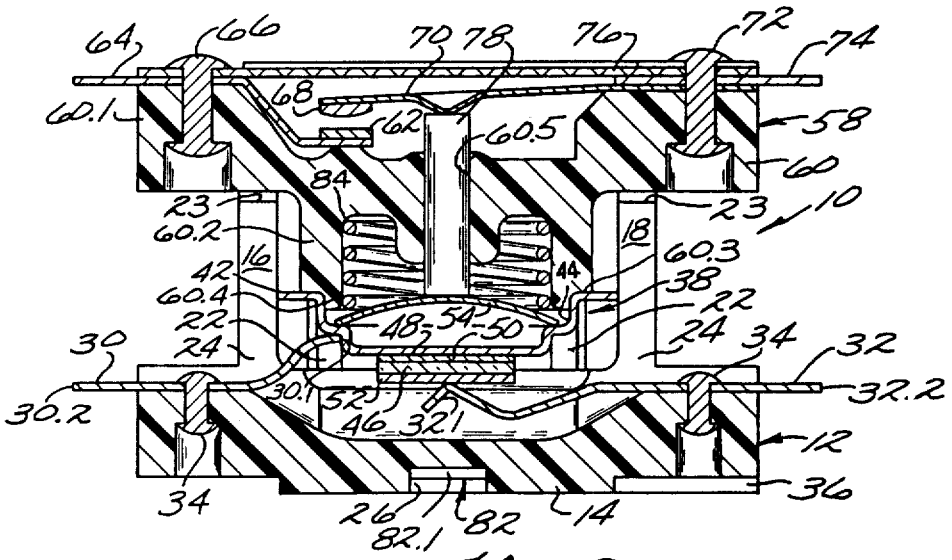
FIG. 2 is a section view along line 2—2 of FIG. 1.
Figure 3:
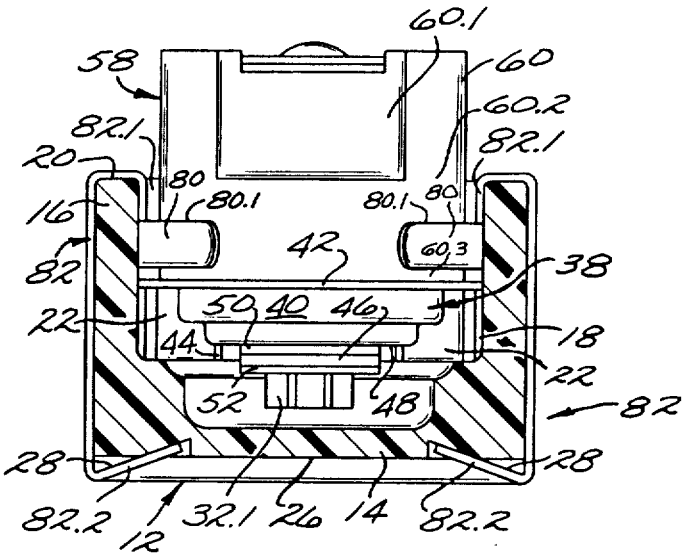
FIG. 3 is a section view along line 3—3 of FIG. 1.

Referring to the drawings, 10 in FIGS. 1-3 indicates the novel and improved time delay relay device of this invention which is shown to include a terminal assembly 12 having a housing 14 molded of a rigid electrical insulating material such as glass-filled nylon or the like. The housing has a circular wall 16 forming a housing chamber 18 which is open at one end 20 and which has a plurality of abutments 22 spaced around the inner wall of the housing chamber at a selected distance from the open chamber end. The housing has slot means such as the pair of slots 23 formed in opposite sides of the chamber wall at the open end of the housing. The housing also has additional openings 24 in the chamber wall 16, the slots 23 and openings 24 preferably being joined as shown to facilitate low-cost molding of the housing. The housing also has a base slot 26 extending across the opposite end of the housing and, as is shown in FIG. 3, the base slot preferably has tapered, reentrant surfaces 28 located in the base slot near the respective opposite ends of the slot. A pair of resilient, electrically conducting spring terminals 30, 32 of beryllium copper or phosphorus bronze or the like are secured to the housing 14 by rivets 34 as shown in FIG. 2 so that first ends 30.1, 32.1 of the terminals are located in a selected position in the chamber 18 near the abutments 22 and so that the opposite ends 30.2, 32.2 of the terminals extend out of the chamber 18 through the openings 24 in the chamber wall. Preferably as shown, the housing has apertured flange portions 36 for use in mounting the time delay relay 10.

The relay 10 further includes an electrical resistance heater unit 38 which, as is shown in FIGS. 2 and 3, preferably includes an open-ended cup 40 of a metal material such as copper having excellent electrical and thermal conductivity properties. The cup is provided with an outer rim or flange 42 and with an inner step 44. The heater unit also includes a resistor member 46, preferably formed of a lanthanum-doped barium titanate or the like, having a positive temperature coefficient of resistivity (PTC). One side 46.1 of the resistor is secured in electrically and thermally conductive relation to the bottom, outer surface 48 of the cup by a layer of silver-filled epoxy adhesive 50 or the like in a conventional manner. An electrical contact layer 52 is also provided on the opposite side 46.2 of the resistor in ohmic contact with the resistor material. In that way, the heater unit 38 forms a self-regulating electrical resistance heater unit in that, as will be understood, the ceramic resistor is adapted to self-heat and to increase in resistivity when electrical current is directed through the resistor until the heater temperature automatically stabilizes at a safe elevated temperature in conventional manner. The heater unit 38 is disposed within the housing chamber 18 so that the heater cup flange 42 rests on the housing abutments 22, thereby to precisely locate the heater unit in the housing so that the conductive cup presses against the resilient terminal 30 and the resistor contact layer 52 presses against the resilient terminal 32 to electrically connect the resistor 46 in series with the terminals.

In accordance with this invention, the relay 10 further includes a thermally-responsive thermostat metal disc 54 which has an original dished configuration at a first-selected temperature but which is adapted to move to an inverted dished configuration with snap action when heated or cooled to a second, selected disc temperature. Typically for example, the bimetallic disc element 54 has a dished configuration as shown in FIG. 2 when the disc is at room temperature but is adapted to move to an inverted dished configuration when the disc is heated to a second, relatively higher predetermined temperature. The disc, which is shown as a single-layer material in FIG. 2 for greater clarity of illustration is disposed within the cup 40 with the disc perimeter resting on the cup step 44.

The relay 10 also includes a switch assembly 58 having contact means mounted on a body 60 of rigid insulating material for movement between open and closed circuit positions in a conventional manner. Preferably, a first-stationary contact 62 mounted on a first switch terminal 64 is secured to a first generally rectangular part 60.1 of the body by a rivet 66. A second contact 68 is mounted on a resilient conductive is contact arm 70 which is secured to the body part 60.1 by a rivet 72 so that contact 68 is moveable into and out of engagement with the stationary contact as will be understood. The arm 70 is normally biased to hold the contacts engaged with each other. A second switch terminal 74 is electrically connected to the contact arm 70 on the body by the rivet 72 and, in a preferred embodiment of the invention, a cover 76 of insulating material is secured to the body over the contacts by the rivets 66 and 72 or in other conventional manner. The first rectangular part 60.1 of the switch assembly body is fitted into the slot means 23 at the open end of the terminal assembly housing as is shown in FIGS. 1 and 2.

The switch body 60 also includes a second cylindric portion 60.2 which depends from the first rectangular portion of the body and which fits into the open end of the terminal assembly housing chamber 18. The end 60.3 of the cylindric portion bears against the flange 42 of the heater unit cup as is shown in FIGS. 2 and 3, thereby to precisely position the heater unit 38 in the relay 10. The cylindric portion also has an annular end abutment 60.4 which fits down inside the heater cup as is best shown in FIG. 2. The abutment centers the cup on the cylindric body part. The cylindric body part 60.2 also includes an axial passage 60.5. A motion transfer pin 78 of a ceramic insulating material or the like is slidably disposed in the passage extending between the disc 54 and the resilient arm 70. Bosses 80 are formed on opposite sides of the cylindric part of the switch body so that, when it fits down into the chamber 18, the bosses 80 are aligned over the reentrant surface portions 28 in the terminal housing base slot.

The relay further includes a pair of stiffly resilient metal spring clips 82 formed of stainless steel or the like each of which has one hooked end 82.1 fitted over a portion of the wall of the terminal housing chamber 18 so that the hooked ends fit down into the chamber and bear against oppositely facing surfaces 80.1 of the bosses on the switch assembly. Each of the clips also has an opposite end 82 which is turned or hooked into the base slot 26 so that the ends 82.2 resiliently engage respective, tapered, reentrant surfaces 28 in the base slot, thereby to draw and hold the switch assembly 58 and the terminal assembly securely and reliably together in assembled relation with the heater unit 38, the disc 54, and the pin 78.

In the preferred embodiment of the invention as illustrated in the drawings, the clips 82 resiliently hold the switch body end 60.3 firmly against the heater cup flange 40 to securely position the heater unit 38 in the relay. The disc 54 as positioned in the cup is in excellent heat-transfer relation to the heater 46. Where the disc 54 has the dished configuration at room temperature as shown in FIG. 2, the disc normally positions the pin 78 so that it bears against arm 70 to hold the contact 68 in open circuit position against the bias of the arm 70. Accordingly, when the disc 54 is heated by energization of the unit 38 so that it moves with snap action to an inverted dished configuration the dished disc fits down into the heater cup 40 as will be understood so that the pin 78 moves in response to the disc movement and under the bias of arm 70 to permit contact 68 to move to a closed circuit position engaging the contact 62. The end abutment 60.4 on the switch body fits down into the cup 40 to axially align the cylindric part 60.2 and the cup 40 so that the pin 78 properly extends from the peak of the disc 54 to the arm 70. Alternately of course the disc 54 can have an oppositely dished original configuration permitting the contact 68 to be normally disposed in closed circuit position the disc being adapted to snap for moving the pin 78 and the arm 70 to open the circuit with a selected time delay after energizing of the heater 38.

In a particularly preferred embodiment of the invention a coil spring 84 is enclosed between the switch assembly 58 and the disc 54 as shown in FIG. 2 for assuring accurate thermal response of the disc 54 when it is heated. Alternately, the coil spring can be replaced with an annular wave spring (not shown) disposed between the perimeter of the disc 54 and the end abutment 60.4 in the switch body or in other conventional manner.

In that way, the relay 10 incorporates components which are of low-cost structure and which also have particular structural features cooperating with the pair of metal clips 82 to permit reliable and accurate relay assembly in an economical and advantageous manner. That is, the clips are readily hooked over the wall of the chamber 18 and are then easily pressed into the base slot 28 to firmly secure the relay together with accurate relative positioning of the switch components. The clips are securely locked into the relay but are compactly fitted where the clips are not rendered conductive and are accommodated in the base slot 28 and in the chamber without adding the bulk of the relay.

It should be understood that although particular embodiments of the invention are described by way of illustrating the invention, the invention includes all modifications and equivalents of the described embodiments falling within the scope of the appended claims.

We claim:

1. A time delay relay comprising a housing having an open-ended chamber and having a pair of terminals extending from the chamber, a resistance heater having a metal cup and having a resistor of a material of positive temperature coefficient of resistivity secured with one side in electrically and thermally conductive relation to the cup, the heater being disposed in the chamber with the cup electrically engaging one terminal and with the opposite side of the resistor electrically engaging the other terminal for electrically energizing the heater, and switch means secured to the housing having contact means moveable between open and closed circuit positions, having thermally responsive means moveable with snap action when heated to a selected temperature, and motion transfer means moveable in response to the thermally responsive means for moving the contact means between said circuit positions, characterized in that, the switch means has a portion fitted into the open end of the housing engaging the heater cup for holding the heater in selected heat-transfer relation to the thermally-responsive switch means, the switch portion having boss means on opposite exterior surfaces thereof, and a pair of resilient metal clips have respective first hooked ends extending into the open chamber end engaging the boss means and have opposite ends engaging the housing to hold the switch means and housing in said assembled relation for moving the contact means to one of said circuit positions with a selected delay after energizing the heater.

2. A time delay relay comprising:

a housing having a chamber open at one end, having abutments inside the chamber spaced from the open chamber end, and having a slot extending across an opposite end of the housing;

a pair of resilient terminals secured to the housing to extend from the chamber;

a resistance heater having a metal cup with a flanged rim and having a resistor of a material positive temperature coefficient of resistivity secured with one side in electrically and thermally conducting relation to the cup, the heater being disposed in the chamber with the cup rim resting on the abutments, with the cup electrically engaging one of the terminals, and with an opposite side of the resistor electrically engaged with the other terminal for permitting energizing of the heater;

an insulating switch body having a fixed contact means mounted on the body, having a resilient contact arm means mounted on the body for movement between open and closed circuit positions respectively spaced from and engaged with the fixed contact means, and having a portion of the body fitted into the open housing chamber end engaging the heater cup rim for securing the heater in a selected position in the chamber, the body portion fitted into the chamber having boss means on opposite outer surfaces thereof and having a passage extending axially through the body portion;

a thermally-responsive dished thermostatic disc disposed in the cup in selected heat-transfer relation to the resistor to be moveable with snap action to an inverted dished configuration when heated to a selected temperature;

a motion-transfer pin slidable in the passage between the disc and contact arm means for moving the arm means between said circuit positions in response to said snap-action movement of the disc; and a pair of resilient metal clips having first hooked ends fitted down inside the housing chamber to engage the switch body bosses and having opposite hooked ends fitted into the slot in the opposite end of the housing securing the switch body and housing together enclosing the disc for moving the contact arm means between said circuit positions with a selected time delay after energizing of the heater.

3. A time delay relay as set forth in claim 2 wherein the housing has a base and has a cylindric wall upstanding from the base forming the open-ended housing chamber, said slot extending across the base and the housing having additional slot means in the cylindric wall at the open end of the housing chamber, the switch body portion fitted into the housing chamber being of generally cylindric configuration and the body having an additional rectangular portion fitted into said slot means at the open-housing end so that the clip means securing the body and housing together secure the body in a selected position of rotation relative to the housing.

4. A time delay relay as set forth in claim 3 wherein the housing base slot has reentrant surface portions at the ends of the base slot receiving said respective opposite hooked ends of the metal clips for accommodating the hooked ends and for locking the clips to the housing.

5. A time delay relay as set forth in claim 4 wherein the hooked metal clip ends engaging the boss means on the switch body are hooked over respective portions of the cylindric housing wall for locking the switch body in assembled relation to the housing.

* * * * *